United States Patent [19]

Yencha

[11] Patent Number: 4,867,132

[45] Date of Patent: Sep. 19, 1989

[54] GAS FIRED CONVECTION OVEN WITH IMPROVED AIR DELIVERY AND HEAT EXCHANGE STRUCTURE

[75] Inventor: Michael V. Yencha, Freeland, Pa.

[73] Assignee: Garland Commercial Industries, Inc., Freeland, Pa.

[21] Appl. No.: 275,267

[22] Filed: Nov. 23, 1988

[51] Int. Cl.[4] ..... F24C 15/32

[52] U.S. Cl. ..... 126/21 A; 432/176; 432/199; 126/21 R

[58] Field of Search ..... 126/21 R, 21 A, 19 R, 126/20, 91 A, 39 C; 34/196, 219; 432/176, 199; 165/122, 125; 99/473, 474, 446, 475, 447; 219/400

[56] References Cited

U.S. PATENT DOCUMENTS

| | | | |
|---|---|---|---|
| 3,710,775 | 1/1973 | Tamada et al. | 126/21 A |
| 3,991,737 | 11/1976 | Del Fabbro | 126/21 A |
| 4,108,139 | 8/1978 | Gilliom et al. | 126/21 A |
| 4,395,233 | 7/1983 | Smith et al. | 432/176 |
| 4,467,777 | 8/1984 | Weber | 126/21 A |
| 4,484,561 | 11/1984 | Baggott et al. | 126/21 A |
| 4,498,453 | 2/1985 | Ueda | 126/21 A |
| 4,516,012 | 5/1985 | Smith et al. | 219/400 |
| 4,627,409 | 12/1986 | Kagomoto | 126/21 A |
| 4,648,377 | 3/1987 | Van Camp | 126/21 A |
| 4,671,250 | 6/1987 | Hurley et al. | 126/21 A |

*Primary Examiner*—James C. Yeung

*Attorney, Agent, or Firm*—Hubbard, Thurman, Turner & Tucker

[57] ABSTRACT

A gas fired convection cooking oven is provided with an improved air delivery and heat exchange structure for creating within the oven's cooking chamber a recirculating flow of heated air to cook food items supported therein. The structure includes a combustion box adapted to receive hot products of combustion from a gas burner, and extending into the cooking chamber through a lower portion of a vertical boundary wall thereof. Removably secured to the combustion box, and extending upwardly along the inner side of the boundary wall is a hollow baffle structure having a front mixing chamber communicating with the interior of the combustion box through spaced apart hollow legs with a discharge opening formed therebetween. Perforated skirt walls extending rearwardly from the mixing chamber define with the boundary wall a fan chamber which surrounds a motor-driven centrifugal fan impeller supported on the inner side of the boundary wall. During oven operation the recirculating air flow is drawn from the cooking chamber into the mixing chamber, mixed with burner combustion products and flowed into the fan. The flow is then ejected from the fan and forced into the cooking chamber through the skirt wall perforations and through the discharge opening between the mixing chamber leg portions. Removal of the baffle structure from the combustion box and the boundary wall conveniently exposes the fan impeller within the cooking chamber for inspection, cleaning and service purposes.

16 Claims, 3 Drawing Sheets

GAS FIRED CONVECTION OVEN WITH IMPROVED AIR DELIVERY AND HEAT EXCHANGE STRUCTURE

BACKGROUND OF THE INVENTION

The present invention relates generally to cooking apparatus and, in a preferred embodiment thereof, more particularly provides a gas fired convection cooking oven which is provided with an improved air delivery and heat exchange section.

Cooking ovens in which heated air is continuously recirculated through a cooking chamber, to cook food items supported therein, are commonly referred to as "convection" ovens. A motor-driven fan impeller positioned within the oven housing is typically utilized to create the recirculating air flow through the cooking chamber, and cooking heat is conventionally transferred to the recirculated air by means of a gas burner whose combustion products are flowed directly into the fan impeller and/or flowed through a heat exchanger operably interposed in the path of the recirculating air.

A conventional direct-fired convection oven of this general type is illustrated in U.S. Pat. No. 4,648,377 to Van Camp. In the Van Camp oven a centrifugal fan impeller is positioned behind a single metal baffle plate vertically secured within the oven housing and generally defining a side boundary of the cooking chamber. The baffle plate has a central return opening through which recirculating air is returned from the cooking chamber to the fan impeller inlet, and peripheral edge passages through which heated air is forced by the fan impeller into the cooking chamber.

Circumscribing the fan impeller behind the baffle plate is a bifurcated heat exchanger structure having upper and lower manifolds respectively positioned above and below the fan, and a pair of generally U-shaped flow tubes positioned on peripherally opposite sides of the impeller and interconnected between the interiors of the upper and lower manifolds.

During operation of the oven the products of combustion from a gas burner are flowed sequentially into the lower manifold, upwardly through the tubes, and into the upper manifold. Air radially discharged from the impeller is flowed outwardly across and is heated by the external surface of the heat exchanger before being forced through the baffle plate peripheral openings into the cooking chamber.

The burner combustion products entering the upper manifold are discharged therefrom through a downward extension thereof positioned between the central baffle plate opening and the impeller inlet. The discharged combustion products are mixed with return air being drawn into the impeller, thereby directly transferring residual combustion product heat to the recirculating air flow. In alternate embodiments of the Van Camp oven, the upper manifold is eliminated and the open outer ends of the flow tubes are bent inwardly to a position directly in front of the impeller inlet t discharge burner combustion products directly into the impeller inlet.

Despite the apparent heat transfer efficiency of these air delivery and heat exchange structures, they have several inherent limitations and disadvantages. For example, they are fairly complex and relatively expensive to fabricate, assemble and install, thereby increasing the overall cost of the oven. Additionally, access to the fan impeller for cleaning, repair or replacement is somewhat inconvenient because the impeller is positioned behind the baffle plate, which is secured at various locations thereon to the interior of the oven housing, and is also partially blocked by the upper manifold or, as the case may be, outer end portions of the flow tubes. Thus, an appreciable amount of disassembly, and subsequent reassembly, is required to service the fan impeller.

Other conventional gas or electrically heated convection ovens having one or more of these disadvantages and limitations are representatively illustrated in U.S. Pat. No. 3,710,775 to Tamada et al; U.S. Pat. 3,991,737 to Del Fabbro; U.S. Pat. No. 4,108,139 to Gilliom et al; U.S. Pat. No. 4,467,777 to Weber; and U.S. Pat. No. 4,671,250 to Hurley et al.

It is accordingly an object of the present invention to provide a gas fired convection oven having an internal air delivery and heat exchange structure which may be easily, rapidly and inexpensively fabricated, assembled and installed and provides rapid and complete access to the fan impeller from the interior of the cooking chamber.

SUMMARY OF THE INVENTION

In carrying out principles of the present invention, in accordance with a preferred embodiment thereof, an improved air delivery and heat exchange structure is incorporated in a gas fired convection cooking oven having a cooking chamber separated from a motor and burner chamber by a vertically extending boundary wall of the cooking chamber.

The air delivery and heat exchange structure functions to create within the cooking chamber a recirculating flow of heated air to cook items supported therein and comprises a combustion box having a front portion extending inwardly through a lower portion of the boundary wall into the cooking chamber. A gas burner is positioned in the motor and burner chamber and has a discharge end, formed .from a cylindrical, spirally wound wire mesh material, which projects forwardly into the combustion box. Also positioned in the motor and burner chamber is a fan motor used to drive a centrifugal fan impeller supported on the boundary wall within the cooking chamber above the inwardly projecting front portion of the combustion box.

Removably secured to the front combustion box portion, and extending upwardly therefrom along the boundary wall, is a hollow baffle structure having a vertically extending front wall with a central opening therein, and interconnected perforated skirt walls extending rearwardly to the boundary wall from the top edge and vertical side edges of the front wall. A vertical dividing wall positioned within the baffle structure and having a central outlet opening therein divides the baffle structure interior into a mixing chamber positioned between the front and dividing walls, and a fan chamber which receives the fan impeller and extends between the dividing wall and the boundary wall.

At their lower ends the front and dividing walls form a spaced pair of hollow, open-ended legs which are releasably held over corresponding outlet openings in the front combustion box portion by clip means formed on the combustion box adjacent such outlet openings, the leg portions forming therebetween an outlet opening which intercommunicates the cooking and fan chambers. A flange formed on the upper skirt wall is screwed to the boundary wall to thereby releasably hold the rear edges of the skirt wall against the boundary wall.

During operation of the fan and burner, combustion products from the burner flow upwardly through the leg portions into the mixing chamber, while an air-combustion product mixture is drawn from the cooking chamber into the mixing chamber through the inlet opening in the baffle structure front wall. These two flows are drawn into the fan impeller inlet through the dividing wall outlet opening, flowed into the fan chamber through the fan impeller outlet, and then forced back into the cooking chamber through the skirt wall perforations and a flow passage defined around the side and top of the baffle structure, and through the outlet opening between the baffle structure inlet leg portions.

Removal of the baffle structure from the boundary wall and the combustion completely exposes the fan impeller within the cooking chamber, thereby providing substantially unimpeded access thereto from within the cooking chamber. Both the baffle structure and the combustion box can be easily and rather inexpensively formed from flat sheet metal stampings which are appropriately bent to form these two simple structures.

DETAILED DESCRIPTION

Figure 1:
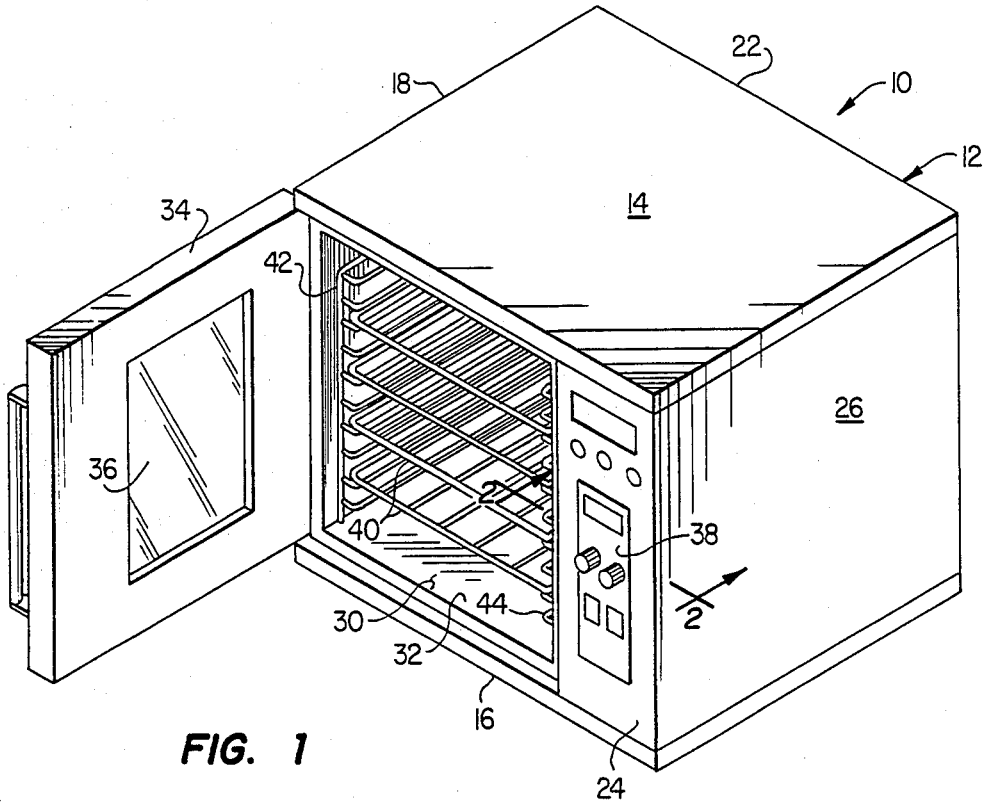
FIG. 1 is a perspective view of an improved gas fired convection oven embodying principles of the present invention.

Perspectively illustrated in FIG. 1 is an improved gas fired convection oven 10 which embodies principles of the present invention. The oven 10 is provided with a housing 12 formed for the most part from internally insulated hollow metal walls including top and bottom walls 14 and 16, a left exterior side wall 18, a right interior side wall 20 (FIG. 2), and a rear wall 22. An uninsulated right side portion 24 of the housing is provided with a side access panel 26 and defines therein a motor and burner chamber 28.

A cooking chamber 30 is positioned within the housing to the left of the insulated interior wall 20, whose inner side forms a boundary surface of the cooking chamber, and is accessible through a front housing side opening 32. A suitable access door 34 having a transparent viewing panel 36 therein is pivotally mounted on the housing to cover and uncover the access opening 32. A control panel 38 (FIG. 1) is mounted on the front side of the housing 12, to the right of the door 34, and is utilized to regulate the operation of the oven 10 in a suitable manner.

A series of metal food support racks 40 are horizontally and removably supported within the cooking chamber 30 by means of vertically extending rack support structures 42 and 44 respectively extending along the left and right interior sides of the cooking chamber. In a generally conventional manner, food items placed on the horizontal racks 40 are subjected to and cooked by a recirculating flow of heated air which traverses the cooking chamber 30 in a manner subsequently described. For purposes of illustrative clarity, the food support racks 40, and their support structures 42 and 44 have been illustrated only in FIG. 1.

Figure 2:
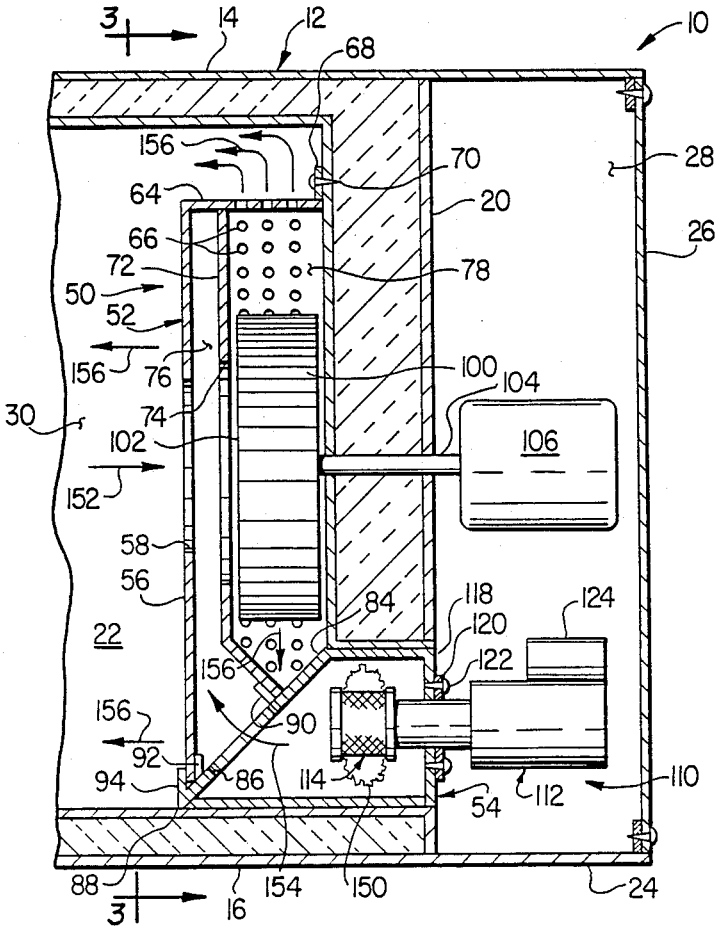
FIG. 2 is an enlarged scale partial cross-sectional view through the oven, taken along line 2—2 of FIG. 1, with the food support structure within the oven's cooking chamber removed for illustrative clarity.

Referring now to FIGS. 2–5, the present invention incorporates in the oven 10 an improved air delivery and heat exchange structure 50 which, compared to its conventional counterparts typically utilized in convection ovens of this general type, provides a variety of structural and operational advantages. Structure 50 includes a vertically extending chambered baffle portion 52 which is removably supported on and projects upwardly from a base portion 54 which rests upon the bottom housing wall 16 and, in a manner subsequently described, functions as a combustion box. As best illustrated in FIG. 2, the chambered baffle portion 52 is positioned within the cooking chamber 30 against the insulated right side interior wall 20, and the base portion 54 extends through the wall 20 into the motor and burner chamber 28.

The baffle portion 52 has a vertically elongated, generally rectangular front wall 56 having a circular opening 58 formed centrally therethrough. Extending rearwardly from the side and top edges of the front wall 56 are interconnected side and top skirt walls 60, 62 and 64, each of which has a spaced series of relatively large circular perforations 66 formed in a rear portion thereof. The rear side edges of the skirt walls 60, 62 and 64 are positioned against the insulated interior housing side wall 20 as best illustrated in FIG. 2, and the top skirt wall 64 is provided at its rear side edge with an upturned mounting flange 68 which is secured to the housing wall 20 with suitable fasteners such as screws 70 (FIG. 2).

Secured within the generally U-shaped skirt wall portion of the chambered baffle structure 52 is an interior wall 72 which is parallel to the front wall 56, and is spaced rearwardly therefrom and forwardly of the skirt wall perforations 66. A central circular opening 74 is formed in the interior wall 72 and is axially aligned with, and of a somewhat greater diameter than the opening 58 in the front wall 56. The front and rear walls 56, 72 define therebetween a vertically extending mixing chamber 76 within the baffle portion 52, while the interior wall 72 defines with the skirt walls 60, 62 and 64 and the interior housing wall 20 a considerably wider fan chamber 78 behind the mixing chamber 76. On opposite sides thereof, lower end portions of the baffle structure walls 56 and 72 form downwardly and rearwardly sloped hollow legs 80 having open lower ends. The legs 80 form therebetween a horizontally elongated rectangular opening 82 at the base of the baffle portion 52 (see FIG. 3).

Figure 3:
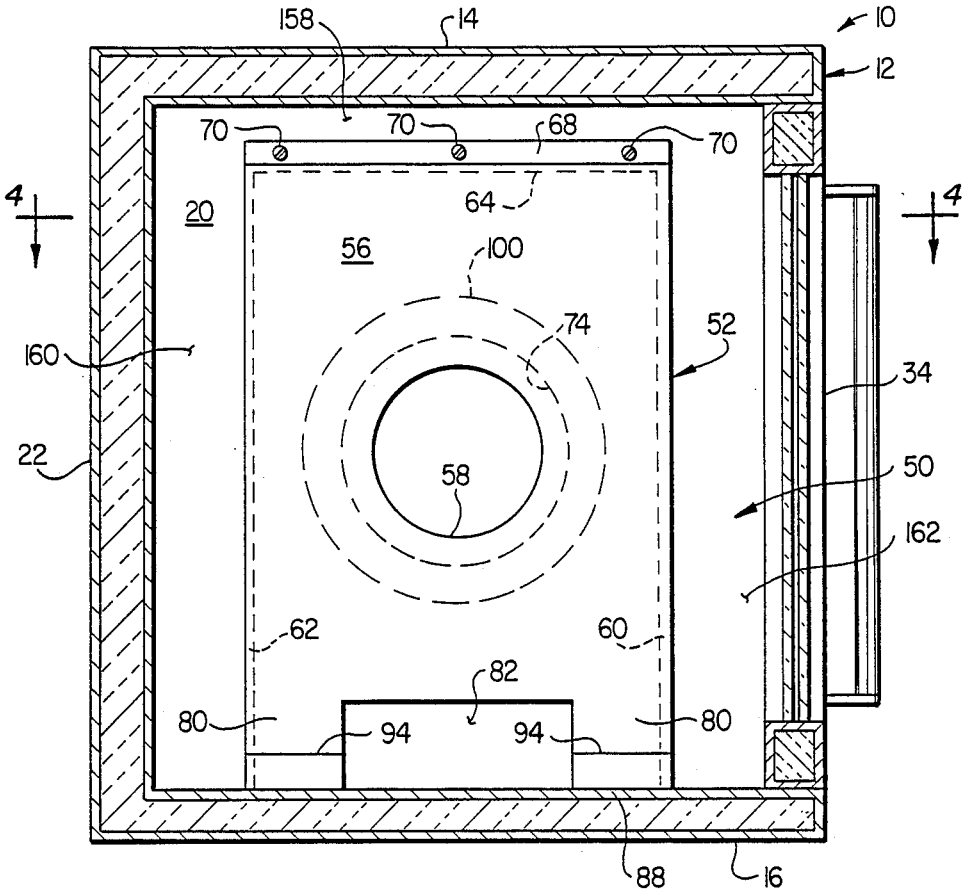
FIG. 3 is a cross-sectional view through the oven taken along line 3—3 of FIG. 2.
Figure 4:
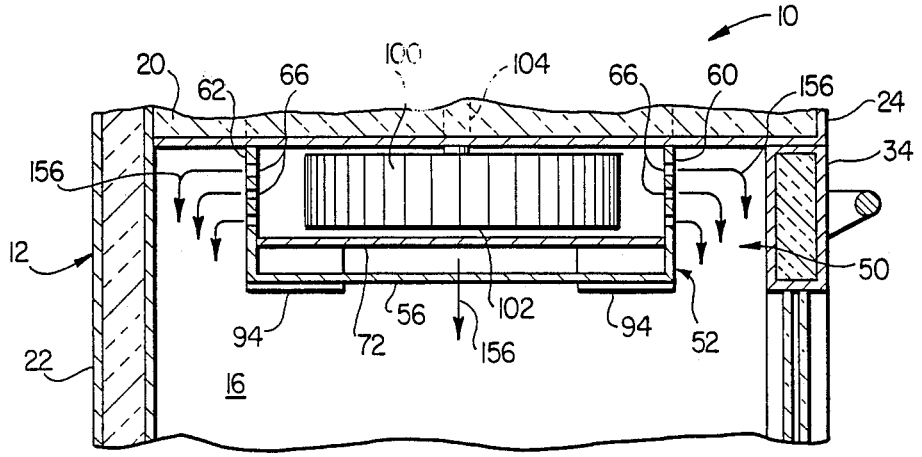
FIG. 4 is a partial cross-sectional view through the oven taken along line 4—4 of FIG. 3.
Figure 5:
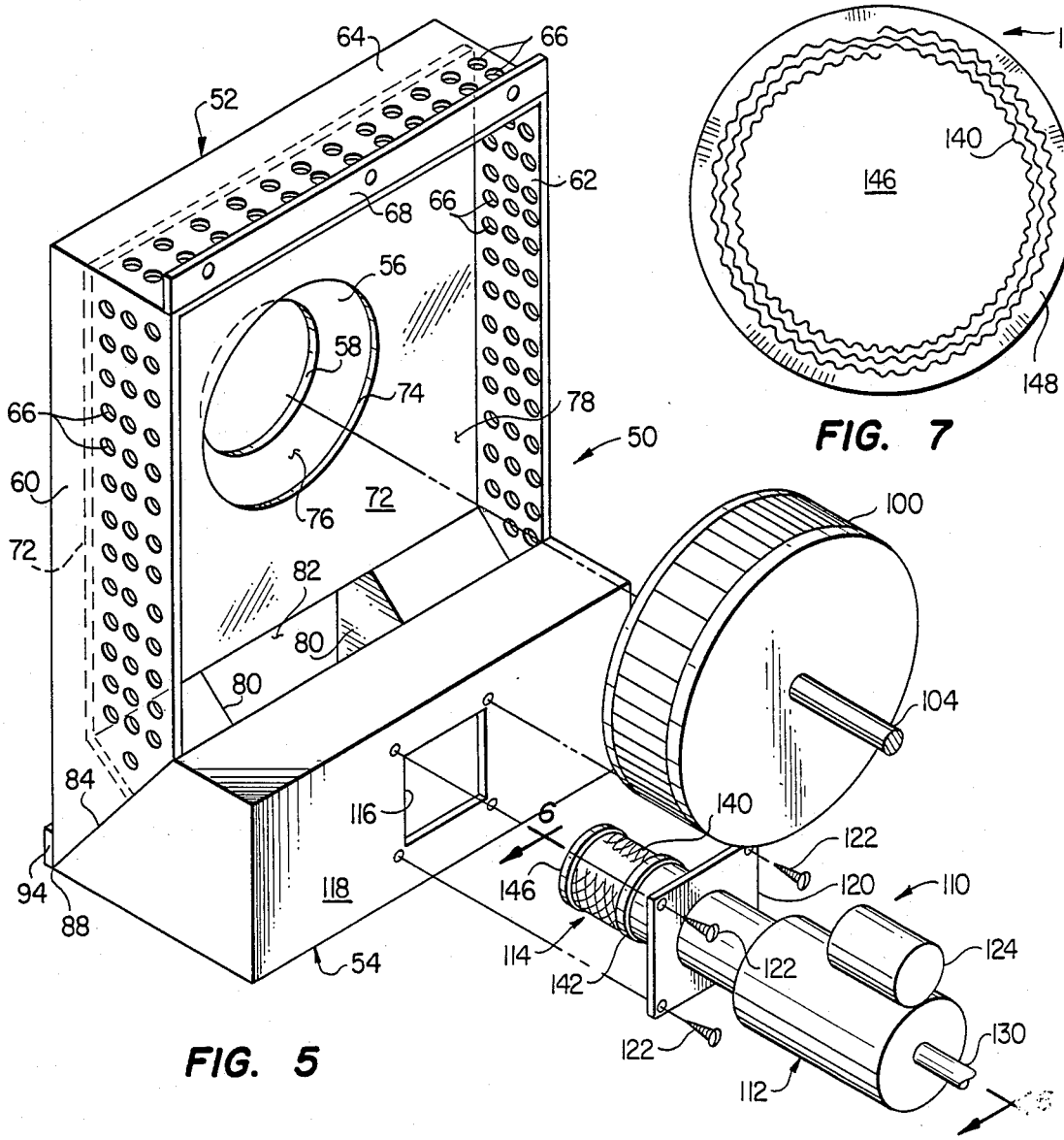
FIG. 5 is an enlarged scale, partially exploded perspective view of an improved air delivery and heat exchange structure incorporated in the oven.
Figure 7:
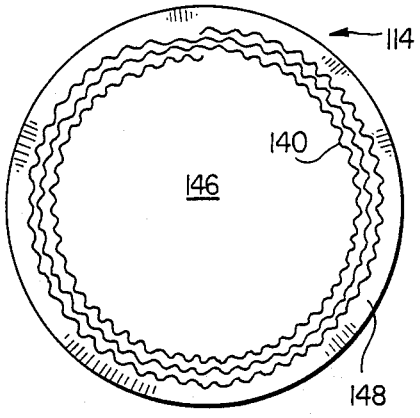
FIG. 7 is an enlarged scale cross-sectional view through the discharge end of the burner, taken along line 7—7 of FIG. 6.
Figure 6:
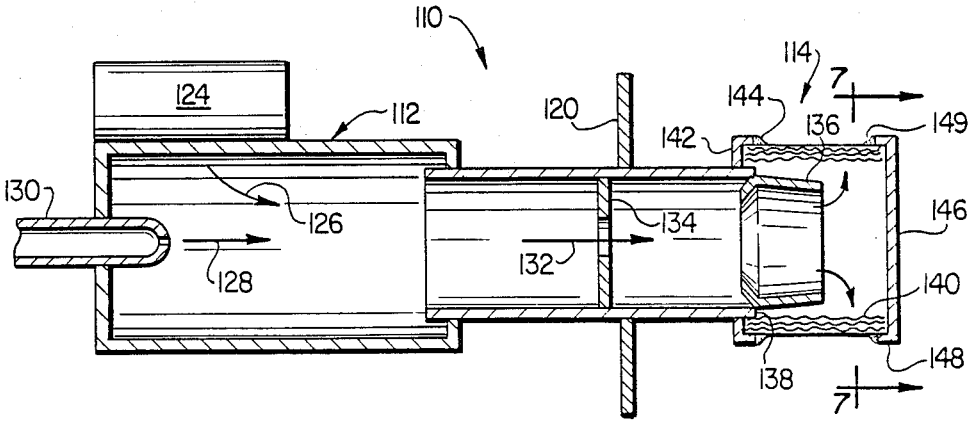
FIG. 6 is an enlarged scale, somewhat schematic cross-sectional view through the burner portion of the air delivery and heat exchange structure, taken along line 6—6 of FIG. 5.

The base portion 54 of the air delivery and heat exchange structure 50 is provided with a downwardly and forwardly sloping front wall 84 having a pair of rectangular openings 86 (see FIG. 2) formed through its opposite ends adjacent its lower front side edge 88. Along the upper and lower side edges of each of the wall openings 86 a pair of outwardly projecting upper and lower alignment tabs 90 and 92 are formed, such alignment tabs being received within the open lower ends of the baffle structure legs 80 as best illustrated in FIG. 2. A pair of upturned retaining tabs 94 are formed on opposite ends of the lower front side edge 88 of the base portion front wall 84 and extend upwardly along front sides of the legs 80 as best illustrated in FIG. 3. The tabs 90, 92 and 94 function to removably support the open lower ends of the legs 80 over the wall openings 86 in the base portion 54, while the mounting flange 68 functions to removably connect an upper end portion of the chambered baffle structure 52 to the interior housing wall 20. For purposes later described, the entire chambered baffle structure 52 may be removed simply by removing the screws 70 and disengaging the legs 80 from their associated tabs 90, 92 and 94 on the base portion 54.

Operatively positioned within the fan chamber 78 is a centrifugal fan impeller 100 having an inlet 102 which is coaxial with and positioned directly behind the interior wall opening 74 of the baffle structure. The fan impeller 100 is rotationally drivable by means of a drive shaft 104 extending through the interior housing wall 20 and connected to a fan motor 106 positioned in the motor and burner chamber 28 as best illustrated in FIG. 2.

Referring now to FIGS. 2 and 5–7, the air delivery and heat exchange structure 50 also includes a gas burner 110 having a hollow, generally cylindrical body portion 112 positioned in the motor and burner chamber 28, and a discharge tip portion 114 which is inserted into the base portion 54 through a rectangular opening 116 formed in its rear wall 118. The burner 110 is supported in the chamber 28 by means of a rectangular mounting flange 120 externally welded to the burner body 112 and removably secured to the base portion rear wall 118 by screws 122. Burner 110 is of an air boosted type and has a blower 124 secured to its body 11 and adapted to force pressurized air 126 into the burner body for mixture with pressurized gaseous fuel 128 supplied to the body interior by a suitable gas supply pipe 130. The incoming air and fuel stream 126 and 128 are mixed within the burner body 112 to form a fuel-air mixture 132 that is forced forwardly through an orifice washer 134 secured within the burner body to facilitate the mixing of the incoming air and fuel. The fuel-air mixture 132 is flowed into the tip section 114 through an outlet fitting 136 secured to the inner end 138 of the burner body.

The burner tip section 114 comprises a hollow cylindrical spirally wound section 140 of metal wire mesh which is received at one end in an annular external mounting flange 142 secured to the inner end 138 of the burner body. An annular braze bead 144 is used to fixedly secure the wire section 140 to the flange 142. A circular cap member 146 having a peripheral flange 148 is fixedly secured over the opposite end of the mesh section 140 by means of a braze bead 149. During operation of the burner 110, the fuel-air mixture 132 is forced laterally outwardly through the wire mesh section 140 around its periphery, and is ignited by conventional igniter means (not illustrated) to form around the mesh section periphery a compact "blue flame" 150 positioned within the base portion 54 as illustrated in FIG. 2. The overlapping mesh construction of the section 140 provides a very economical and easily fabricated means for evenly distributing and uniformly diffusing the flame around the burner tip. However, if desired, an alternate, generally porous material (such as a porous ceramic material) could be used in place of the illustrated wire mesh.

During operation of the oven 10 a flow 152 of return air and combustion products is drawn through the front wall opening 158 into the mixing chamber 176 by operation of the fan 100, and is mixed in chamber 76 with combustion products 154 emanating from the flame 150 and flowed upwardly through the chamber 76 through the open leg portions 80 of the baffle portion 52. The return air-combustion product mixture in the chamber 76 is drawn into the fan inlet 102 through the interior wall opening 74 and is ejected radially from the fan impeller 100 into the fan chamber 78. The return air-combustion product mixture 156 forced into the fan chamber 78 is forced outwardly through the skirt wall perforations 66, and forwardly through the rectangular opening 82 between the baffle structure legs 80. The return air-combustion product mixture 156 exiting the baffle structure in this manner is then flowed outwardly into the cooking chamber 30 through the rectangular opening 82, as well as through a supply passage having top and side supply portions 158, 160 and 162 defined between the top and vertical side walls of the baffle structure 52 and the top and vertical side surfaces of the cooking chamber 30. In this manner, the air-combustion product mixture 156 is very evenly distributed throughout the cooking chamber 30 as it is recirculated therethrough and functions to cook food items operatively supported on the racks 40 within the cooking chamber. This very even cooking air distribution within the cooking chamber 30 is further enhanced by the skirt wall perforations 66 which serve to evenly diffuse the air-combustion product mixture exiting the top and vertical side wall portions of the baffle structure 52. In a conventional manner vent means (not illustrated) are provided to continuously exhaust from the cooking chamber a small portion of the air-combustion product mixture being circulated therethrough.

The portion of the flow 156 downwardly discharged from the fan 100 impinges upon the outer side surface of the base portion front wall 84 and is also flowed along the rear and vertical side surfaces of the baffle structure inlet legs 80 to thereby very efficiently receive heat from and cool these hottest portions of the overall air delivery and heat exchange structure 50.

It can readily be seen from the foregoing that the air delivery and heat exchange structure 50 of the present invention provides distinct and structural and operational advantages compared to conventional air delivery and heat exchange structures utilized in convection ovens of this general type. For example, the chambered baffle portion 52 and the base portion 54 may be easily and relatively inexpensively formed from flat sheet metal stampings which are appropriately bent and intersecured to form these two structural elements. Despite this structural simplicity, the releasably intersecured baffle and base portions 52 and 54 serve to simultaneously transfer heat to the air discharge from the fan 100 and directly flow burner combustion products into the inlet of the fan.

However, despite this very desirable and efficient dual heat transfer function provided by the baffle and base portions 54, both the fan and burner elements 100, 110 are very easily and rapidly accessible for inspection, service and maintenance. For example, complete access to the fan impeller 100 from within the cooking chamber is rapidly achieved simply by removing the screws 70 and pulling the baffle structure 52 outwardly from the base portion 54 to completely expose the fan impeller 100 within the cooking chamber 30. Rapid reassembly of the baffle and base portion 54 is easily accomplished by simply reengaging the baffle structure legs 80 with their base portion clips and reinserting the screws 70. Additionally, complete access to the fan motor 106 and the gas burner 110 is achieved simply by removing the side access panel 26.

The foregoing detailed description is to be clearly understood as being given by way of illustration and example only, the spirit and scope of the present invention being limited solely by the appended claims.

What is claimed is:

1. A convection oven comprising a housing having a cooking chamber within which a food item to be cooked may be supported, and air delivery and heat exchange means for creating within said housing a recirculating flow of heated air which traverses said cooking chamber and is operative to cook a food item supported therein, said air delivery and heat exchange means including:

a combustion box having a portion positioned within said cooking chamber adjacent a boundary surface thereof;

burner means for flowing hot combustion products into the interior of said combustion box;

a hollow baffle structure positioned within said cooking chamber and extending outwardly from said combustion box portion along said boundary surface, said baffle structure having an external periphery spaced inwardly from a portion of the interior cooking chamber surface and defining therewith a supply flow passage extending from said boundary surface past said baffle structure periphery into said cooking chamber, said baffle structure further having:

first wall means for defining a mixing chamber positioned outwardly from said boundary surface and having spaced apart hollow leg portions that define an opening therebetween and communicate with the interior of said combustion box, second wall means, extending from said first wall means toward said boundary surface, for defining with said boundary surface and said first wall means a fan chamber which communicates with said cooking chamber through said opening between said leg portions of said first wall means, said second wall means having openings therein through which said supply flow passage and said fan chamber communicate, an inlet opening formed in said first wall means and intercommunicating said cooking chamber and the interior of said mixing chamber, and an outlet opening formed in said first wall means and intercommunicating the interiors of said mixing chamber and said fan chamber;

fan means, including a fan impeller positioned with said fan chamber, for cooperating with said burner means during operation of said convection oven to continuously flow combustion products from said burner means into said mixing chamber through said hollow leg portions of said first wall means and into the inlet of said fan impeller through said outlet opening in said first wall means, flow a mixture of air and combustion products from said cooking chamber into said mixing chamber through said inlet opening in said first wall means and into the inlet of said fan impeller through said outlet opening in said first wall means, and flow the air and combustion products received by said fan impeller outwardly from said fan chamber into said cooking chamber through said opening between said hollow leg portions of said first wall means and through said second wall means openings and said supply flow passage; and means for detachably associating said baffle structure with said combustion box and said boundary surface in a manner permitting said baffle structure to be readily removed therefrom to provide substantially unimpeded access to said fan impeller from within said cooking chamber.

2. The convection oven of claim 1 wherein:

said housing has a motor and burner chamber positioned therein adjacent said cooking chamber, said burner means include a gas burner having a body portion positioned in said motor and burner chamber, and a discharge portion extending inwardly into said combustion box, and said fan means include motor means, positioned in said motor and burner chamber, for rotationally driving said fan impeller.

3. The convection oven of claim 2 wherein:

said fan impeller is a centrifugal fan impeller.

4. The convection oven of claim 1 wherein:

said means for detachably associating said baffle structure with said combustion box and said boundary surface include cooperating means on said leg portions and said combustion box for releasably interengaging said leg portions and said combustion box, and means for removably securing said second wall means to said boundary surface.

5. The convection oven of claim 4 wherein:

said combustion box has a pair of outlet openings formed therein, and said cooperating means include outwardly projecting tab means formed on said combustion box adjacent said outlet openings therein for engaging outer ends of said leg portions and holding them over said outlet openings.

6. The convection oven of claim 5 wherein:

said means for removably securing said second wall means to said boundary surface include a flange formed on said second wall means, and fastener means for removably securing said flange to said boundary surface.

7. The convection oven of claim 1 wherein:

said burner means include a gas burner having a cylindrical body portion with an open end projecting into said combustion chamber, and a cylindrical discharge member coaxially secured to and projecting axially outwardly from said open end, said discharge member being formed from a porous material.

8. The convection oven of claim 7 wherein:

said discharge member is formed from a spirally wound length of wire mesh material.

9. Air delivery and heat exchange apparatus for use in creating a recirculating flow of heated air through a cooking chamber of a convection cooking oven, from and to a motor-driven fan impeller mounted on an interior side of a wall of said cooking chamber, said apparatus comprising:

a hollow combustion box adapted to internally receive hot combustion products from a fuel burner, said combustion box having a front portion extendable through a lower portion of said cooking chamber wall into said cooking chamber, said front portion of said combustion box having a combustion products outlet opening formed therein;

a hollow baffle structure having:

a vertical front wall with an inlet opening formed therethrough, said front wall having vertical side edges and a top edge, interconnected skirt walls extending rearwardly from said front wall edges and having rear edges defining a rear opening in said baffle structure, a vertical interior wall positioned between said front wall and said rear skirt wall edges and having an outlet opening formed therethrough, said interior wall forming with said front wall and front portions of said skirt walls a mixing chamber having an open lower end portion, and forming with rear portions of said skirt walls a fan chamber, and a series of mutually spaced discharge openings formed through said rear portions of said skirt walls; and means for removably securing said baffle structure to said front portion of said combustion box with said combustion products outlet opening communicating with the interior of said open lower end portion of said mixing chamber, said impeller received in said fan chamber above said front portion of said combustion box, said rear skirt wall edges being closely adjacent said interior side of said cooking chamber wall, and said discharge openings in said skirt walls being positioned inwardly from facing interior surface portions of said cooking chamber, said baffle structure being removable from said front portion of said combustion box to thereby substantially completely expose said fan impeller within said cooking chamber.

10. The apparatus of claim 9 wherein:

said front portion of said combustion box has a spaced apart pair of combustion products outlet openings therein, said open lower end portion of said mixing chamber is defined by a spaced pair of hollow legs having open lower ends and defining therebetween a discharge opening extending from said fan chamber outwardly through said front wall of said baffle structure, and said means for releasably securing include tab means for releasably securing said leg portions to said front portion of said combustion box over said combustion products outlet openings therein.

11. The apparatus of claim 10 wherein:

said tab means include retaining tabs formed on said front portion of said combustion box adjacent the peripheries of said combustion products outlet openings and releasably receivable within said hollow leg portions.

12. The apparatus of claim 11 wherein:

said front portion of said combustion box has a downwardly and forwardly sloping front wall with a lower front edge, said combustion products outlet openings are formed in said front wall of said combustion box, and said tab means further include retaining tabs projecting upwardly from said lower front edge and positioned to outwardly overlie a lower end portion of said front wall of said baffle structure.

13. The apparatus of claim 10 further comprising:

means for releasably securing a portion of said skirt walls to said interior side of said cooking chamber wall.

14. A convection oven comprising a housing having a cooking chamber within which a food item to be cooked may be supported, and air delivery and heat exchange means for creating within said housing a recirculating flow of heated air which traverses said cooking chamber and is operative to cook a food item supported therein, said air delivery and heat exchange means including:

a combustion box having a front portion positioned within said cooking chamber adjacent the inner side of a boundary wall thereof;

burner means for flowing hot combustion products into the interior of said combustion box;

a hollow baffle structure positioned within said cooking chamber and extending outwardly from said combustion box portion along said inner side of said boundary wall, said baffle structure having:

a front mixing chamber communicating with the interior of said combustion box, a rear fan chamber positioned behind said mixing chamber and defined in part by said inner side of said boundary wall, first opening means for communicating said cooking chamber with said mixing chamber, second opening means for communicating said mixing chamber with said fan chamber, and third opening means for communicating said fan chamber with said cooking chamber;

a motor-driven fan impeller positioned within said fan chamber and supported on said boundary wall; and means for removably associating said baffle structure with said combustion box and said cooking chamber boundary wall in a manner permitting said baffle structure to be moved apart therefrom to permit substantially unimpeded access to said fan impeller from within said cooking chamber.

15. The convection oven of claim 14 wherein:

said third opening means include wall means for defining a passage extending from said fan chamber outwardly through said mixing chamber, adjacent said front portion of said combustion box, into said cooking chamber.

16. The convection oven of claim 15 wherein:

said fan chamber is defined in part by skirt walls extending rearwardly from said mixing chamber, and said third opening means further include a spaced series of discharge openings formed through said skirt walls.

* * * * *